US011421358B2

(12) United States Patent
Budillon et al.

(10) Patent No.: US 11,421,358 B2
(45) Date of Patent: Aug. 23, 2022

(54) BRAIDING MACHINE, SWITCH FOR A BRAIDING MACHINE, AND SORTING APPARATUS

(71) Applicant: ADMEDES GMBH, Pforzheim (DE)

(72) Inventors: Florent Budillon, Pforzheim (DE); Kevin Lehmann, Pforzheim (DE); Marc O. Braeuner, Pforzheim (DE)

(73) Assignee: ADMEDES GMBH

( * ) Notice: Subject to any disclaimer, the term of this patent is extended or adjusted under 35 U.S.C. 154(b) by 640 days.

(21) Appl. No.: 15/807,830

(22) Filed: Nov. 9, 2017

(65) Prior Publication Data

US 2018/0135215 A1 May 17, 2018

(51) Int. Cl.

| | |
|---|---|
| ***D04C 3/30*** | (2006.01) |
| ***D04C 3/14*** | (2006.01) |
| ***D04C 3/24*** | (2006.01) |
| ***D04C 3/22*** | (2006.01) |
| ***B03C 1/26*** | (2006.01) |
| ***D04C 3/20*** | (2006.01) |
| *B03C 1/12* | (2006.01) |

(52) U.S. Cl.
CPC ..... *D04C 3/30* (2013.01); *B03C 1/26* (2013.01); *D04C 3/14* (2013.01); *D04C 3/20* (2013.01); *D04C 3/22* (2013.01); *D04C 3/24* (2013.01); *B03C 1/12* (2013.01)

(58) Field of Classification Search
CPC ..... B03C 1/12; B03C 1/26; D04C 3/36
See application file for complete search history.

(56) References Cited

U.S. PATENT DOCUMENTS 1,103,181 A * 7/1914 Elliot ..... D04C 3/00 87/51
2,412,353 A * 12/1946 Parker ..... D03C 7/00 139/104
3,167,168 A * 1/1965 Park ..... B65G 54/02 198/439

(Continued)

FOREIGN PATENT DOCUMENTS

DE 427173 C 3/1926
DE 2643415 A1 4/1977

(Continued)

OTHER PUBLICATIONS

Extended European Search Report dated Jun. 28, 2018; Application No. 17001755.2.

*Primary Examiner* — Jocelyn Bravo
(74) *Attorney, Agent, or Firm* — McDonald Hopkins LLC

(57) ABSTRACT

The present invention relates to a switch for sorting, deflecting, and supplying ferromagnetic elements. Here, the switch comprises at least two electromagnets, which are embodied curved or circular. The magnets may be installed fixed in the switch, on the one hand, or supported on an axis, on the other hand. The ferromagnetic elements are moved by a conveying element through the switches. Advantageously the switch can also be used to control bobbins in a braiding machine. Here, the bobbin can be transferred to another impeller. This way new options are generated with regard to flexibility of braids. Further, this invention offers a considerable reduction of braiding time in case of complex braids.

9 Claims, 15 Drawing Sheets

(56) References Cited

U.S. PATENT DOCUMENTS 3,621,979 A * 11/1971 Kraeft ..... B65G 21/2018 198/867.13
3,834,271 A * 9/1974 Hinds ..... D04C 3/06 87/46
4,287,808 A * 9/1981 Leonard ..... D03D 51/02 310/13
4,312,261 A * 1/1982 Florentine ..... D03D 41/004 87/33
4,586,668 A * 5/1986 Mori ..... B65H 67/067 242/474.1
4,615,256 A * 10/1986 Fukuta ..... D03D 41/004 139/11
4,881,444 A * 11/1989 Krauland ..... D04C 1/06 87/8
5,067,525 A * 11/1991 Tsuzuki ..... D04C 1/06 139/11
5,070,914 A * 12/1991 Fukuta ..... D03D 13/00 139/11
5,076,330 A * 12/1991 Kimbara ..... B29C 70/24 139/11
5,127,509 A * 7/1992 Kohlen ..... B65H 67/086 198/345.3
5,295,570 A * 3/1994 Grecksch ..... B65G 21/2009 198/465.1
5,301,596 A * 4/1994 Huey, Jr. ..... D04C 3/38 87/50
5,388,498 A * 2/1995 Dent ..... D04C 1/06 87/50
5,501,133 A * 3/1996 Brookstein ..... D04C 1/06 87/33
5,683,046 A * 11/1997 Badiali ..... B65H 67/02 198/745
6,325,822 B1 * 12/2001 Chouinard ..... D04C 1/06 623/1.15
6,409,750 B1 * 6/2002 Hyodoh ..... A61F 2/07 623/1.1
6,439,096 B1 * 8/2002 Mungalov ..... D04C 1/06 87/33
6,622,604 B1 * 9/2003 Chouinard ..... D04C 1/06 87/11
6,652,571 B1 * 11/2003 White ..... D04C 1/06 623/1.13
8,397,611 B2 * 3/2013 Mejia ..... D04C 3/38 87/55
8,534,176 B2 * 9/2013 Giszter ..... D04C 3/42 87/55
9,920,462 B2 * 3/2018 Lee ..... D04C 3/22
10,100,446 B2 * 10/2018 Gessler ..... D04C 3/06
10,238,176 B2 * 3/2019 Bruce ..... A43B 23/042
10,378,132 B2 * 8/2019 Jarrell ..... D04C 3/38
2005/0207937 A1 * 9/2005 Itoh ..... G01N 35/04 422/63
2009/0193961 A1 * 8/2009 Jensen ..... B29C 53/564 87/8
2012/0012620 A1 * 1/2012 Mejia ..... D04C 3/38 223/35
2015/0045831 A1 * 2/2015 Allen ..... D04C 3/18 606/228
2015/0218739 A1 * 8/2015 Gessler ..... D04C 3/08 87/50
2015/0299916 A1 * 10/2015 Reinisch ..... D04C 3/46 87/3
2016/0183942 A1 * 6/2016 Allen ..... D04C 1/12 606/228
2018/0223460 A9 * 8/2018 Gessler ..... D04C 3/08

FOREIGN PATENT DOCUMENTS

| | | | |
|---|---|---|---|
| DE | 4201413 | | 7/1993 |
| DE | 69308674 | T2 | 10/1997 |
| DE | 102009020053 | | 11/2010 |
| DE | 102011012166 | A1 | 8/2012 |
| DE | 102012205906 | | 10/2013 |
| EP | 2905366 | A1 | 8/2015 |
| EP | 2910309 | A1 | 8/2015 |
| JP | H01250438 | | 10/1989 |
| SU | 1084072 | A1 | 4/1984 |
| WO | 0153583 | | 7/2001 |
| WO | 2011064200 | A1 | 6/2011 |

* cited by examiner

BRAIDING MACHINE, SWITCH FOR A BRAIDING MACHINE, AND SORTING APPARATUS

The present application claims priority to German Patent Application 10 2016 013 486.0, filed Nov. 11, 2016, the entire disclosure of which is incorporated herein by reference in its entirety.

The present invention relates to a braiding machine, a switch for a braiding machine, and a sorting apparatus.

The patent publication DE10 2011 012 166 A1 describes a braiding machine, which allows the generation of arbitrary braid patterns. Here, different tracks are connected and/or combined to each other via mechanic switches in order to generate different braid patterns. The adjustment of the switches requires some time. This is directly connected to the length of the track. The shorter the track between two switches the faster the switch must be adjusted, or the lace-making process must be interrupted until the positioning of the switch is concluded.

A more flexible braiding machine is desired, which can generate arbitrary braid patterns without any extended adjustment times and without any downtime.

The objective of the invention therefore comprises to provide a braiding machine with higher flexibility and little or no interruption of the braiding process.

This objective is attained in the features of the independent claims. Advantageous variants are defined in the dependent claims.

According to one aspect, a braiding machine is provided with at least two impellers for displacing at least one bobbin and at least one switch for changing and/or reversing a motion track of at least one bobbin, with the bobbin being made at least partially from a ferromagnetic material and the switch including at least one electromagnet.

By the switch system of the braiding machine operating without any mechanic components and the deflection of the bobbin occurring by the electric control of the electromagnet the switch requires less structural space and can also be fastened at any impeller of the braiding machine as required. This way, very high flexibility is yielded, no adjustment time is required for the switch and productivity is increased.

Advantageously at least one bobbin comprises a cylindrical or tapered guide element which can contact a guide surface of at least one electromagnet. Due to the fact that the guide element of the bobbin is cylindrical or tapered it can gently glide over the guide surface of the electromagnet.

Further preferred, the cylindrical guide element is rotationally supported at the bobbin. By the cylindrical guide element being supported at the bobbin in a rotary fashion, here any friction resistance at the guide surface of the electromagnet can be further reduced.

Preferably the electromagnet and/or the guide surface thereof are embodied curved or as an arc. Further preferred, at least one electromagnet is fastened in a manner such that it can be pivotally reset.

A curved embodiment of the guide surface or an embodiment of the guide surface as an arc and/or a support of the electromagnet such that it can be pivotally reset can further improve the guidance of the guide element in order to allow rapid and gentle motion.

Preferably a plurality of impellers is arranged on a planar area over each other and side-by-side in rows and columns or circularly.

According to another preferred embodiment a plurality of impellers is arranged in concentric circles and each of the concentric circles shows the same number of impellers.

Further preferred, at least one additional impeller is arranged in a clearance between at least two of the concentric circles. Due to the fact that an additional impeller is arranged in a clearance between two concentric circles of impellers, the bobbins can be transferred from one of the two concentric circles to the other one of the two concentric circles.

According to another preferred embodiment a plurality of impellers is arranged on the perimeter of a cylinder such that all bobbins are aligned in the direction towards the axis of the cylinder or a plurality of impellers is arranged on the surface of a hemisphere and/or semicircle such that all bobbins show the same distance from a braiding point located in the center of the hemisphere and/or semicircle.

According to another aspect, a switch is provided for a braiding machine for changing and/or inverting the track of motion of a bobbin of the braiding machine, at least partially made from a ferromagnetic material, with the switch showing at least one electromagnet.

Preferably the electromagnet and/or a guide surface thereof are embodied curved or as an arc. Further preferred, at least one electromagnet is fastened in a manner such that it can be pivotally reset.

According to another aspect, a sorting apparatus is provided for ferromagnetic objects with an inlet and an at least two-way branched outlet, with at least one electromagnet being arranged between the inlet and the outlet in order to guide the objects optionally into one or the other path of at least two paths.

Preferably a slider is arranged between the inlet and the outlet upstream in reference to the electromagnet in order to control the feeding of objects and/or a separating apparatus is arranged in the outlet downstream in reference to the electromagnet in order to guide, upon electrification of at least one electromagnet, the objects in the one or the other path of at least two paths.

Further preferred, the inlet is embodied essentially in a funnel shaped fashion and/or a conveyance path is embodied essentially vertically between the inlet and the outlet.

The invention is now explained in greater detail based on a special exemplary embodiment with reference to the attached drawings.

Figure 1:
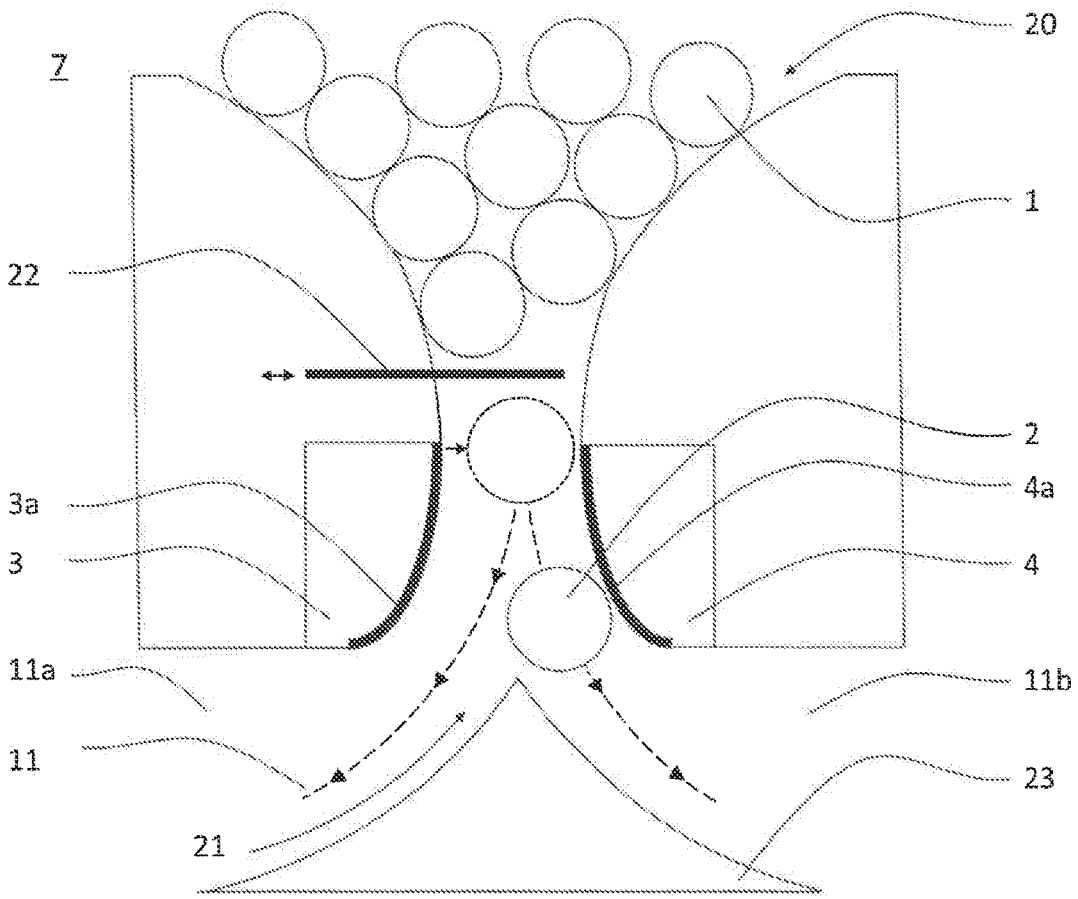
FIG. 1 shows an illustration of a switch according to the invention for sorting, deflecting, and feeding ferromagnetic elements.

In FIG. 1 at first the effective principle of an electromagnetic switch 7 according to a particular embodiment is shown. One or more ferromagnetic objects 1 are fed via a supply path (cf. inlet 20) to the switch W and, depending on the control and/or electrification of an electromagnet 3 and/or an opposite thereof located electromagnet 4, the ferromagnetic objects 1 are deflected to a predetermined and/or predeterminable deflection path 11-1 and/or 11-2, e.g., are deflected laterally (e.g., toward the left or the right) in order, for example by a separating apparatus 23, to be guided accordingly laterally (e.g. towards the left or the right). Here the ferromagnetic objects 1 can be essentially supplied from the top, for example, in order to utilize the gravity of the ferromagnetic objects 1 such that the ferromagnetic objects 1, due to gravity, are fed to the switch 7.

Figure 2:
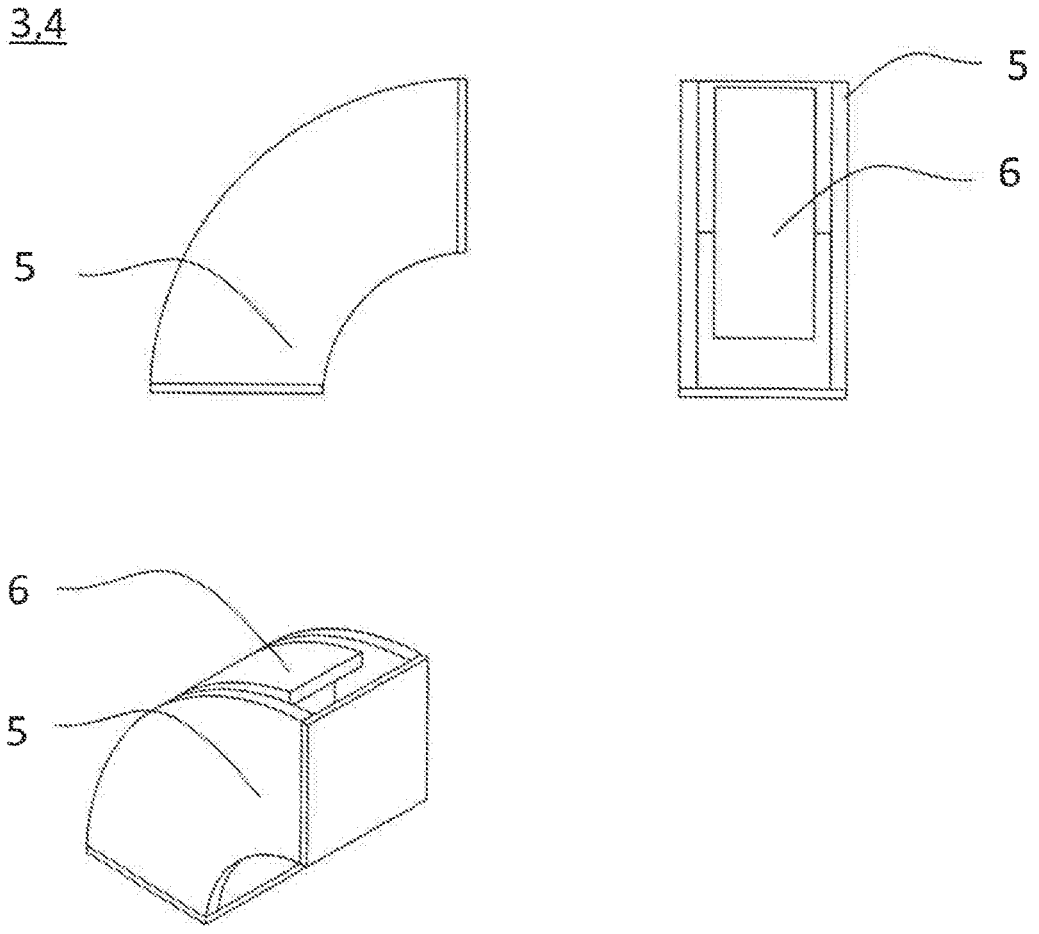
FIG. 2 shows the design of an electromagnet of a switch, depicted from various sides.

In FIG. 2 the electromagnet 3, 4 is illustrated in detail. The electromagnet 3, 4 shows a magnet casing 5 as well as a magnet core 6. By applying a suitable voltage to the magnet core 6 provided with coils it is magnetized and can therefore attract ferromagnetic objects arranged within its magnetic field. By shutting off the electric voltage the magnetic field of the magnet core 6 is essentially reduced completely and/or collapsed and/or eliminated such that any attraction of the ferromagnetic objects 1 no longer occurs. Here, as shown in FIG. 2, the magnet core 6 and the magnet casing 5 are essentially embodied in a curved and/or arc-shaped fashion such that the objects 1 can glide along the (circular) curve of the electromagnet 3, 4.

Figure 3:
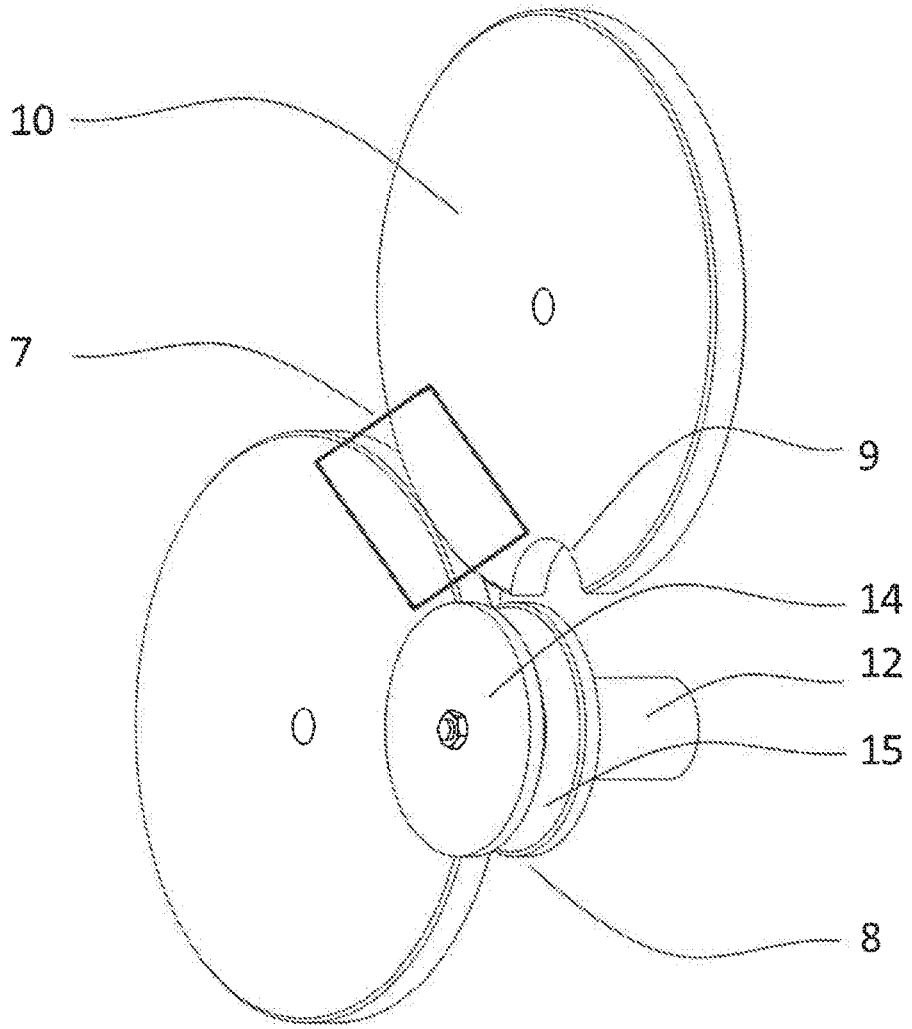
FIG. 3 shows a pair of impellers of a braiding machine, which is equipped with a switch in order to control the motion path of a bobbin of the braiding machine.

In FIG. 3 a braiding machine is shown according to a particular embodiment comprising at least two impellers 10. Each of the impellers 10 comprises at least one conveying groove 9, allowing a bobbin 12 to engage it at least partially, in order to be rotated and/or moved by the impeller 10. For this purpose each bobbin 8 comprises a bobbin base 14 as well as a guide groove 15. When the conveying groove 9 of the impeller 10 engages the guide groove 15 of the bobbin 8 the bobbin 8 is connected and/or coupled positively with the impeller 10 and is entrained and/or moved by the motion of the impeller 10. Furthermore, a switch 7 is arranged at a position between the impellers 10. This position allows a transfer of a bobbin 8 from one of the impellers 10 to the other one of the impellers 10.

As further shown in FIG. 3 the bobbin 8 comprises a guide element 12, which is arranged essentially coaxially in reference to the bobbin base 14 with the guide groove 15. However, the invention is not limited thereto. The guide element 12 can also be arranged in a manner not coaxial in reference to the guide groove 15. The guide element 12 serves for the deflection of the bobbin 8 inside the switch 7, as shown in FIGS. 4 and 5.

Figure 4:
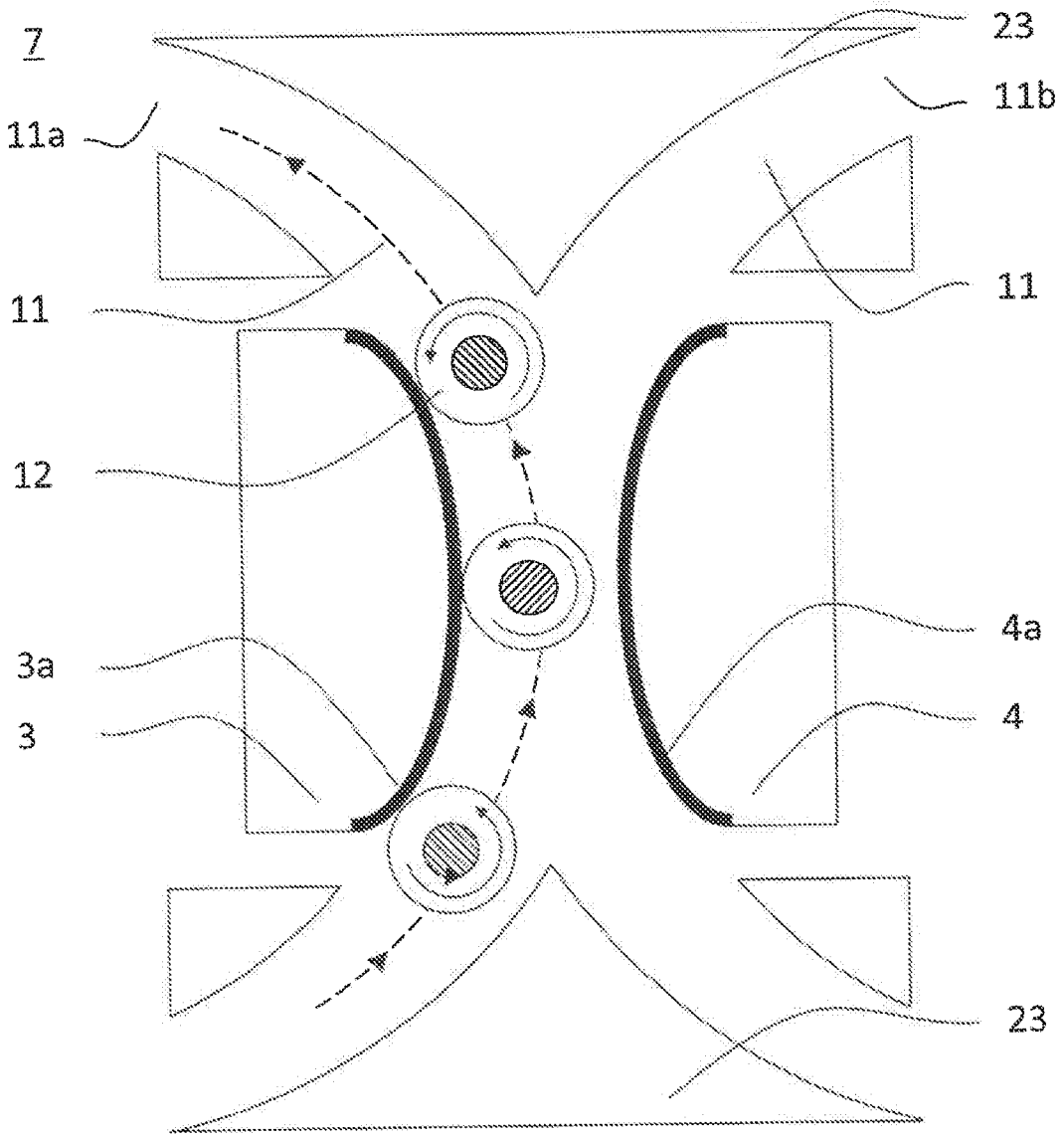
FIG. 4 shows the track of a guide element of a bobbin through the switch in a braiding machine, with the guide element remaining on the impeller.
Figure 5:
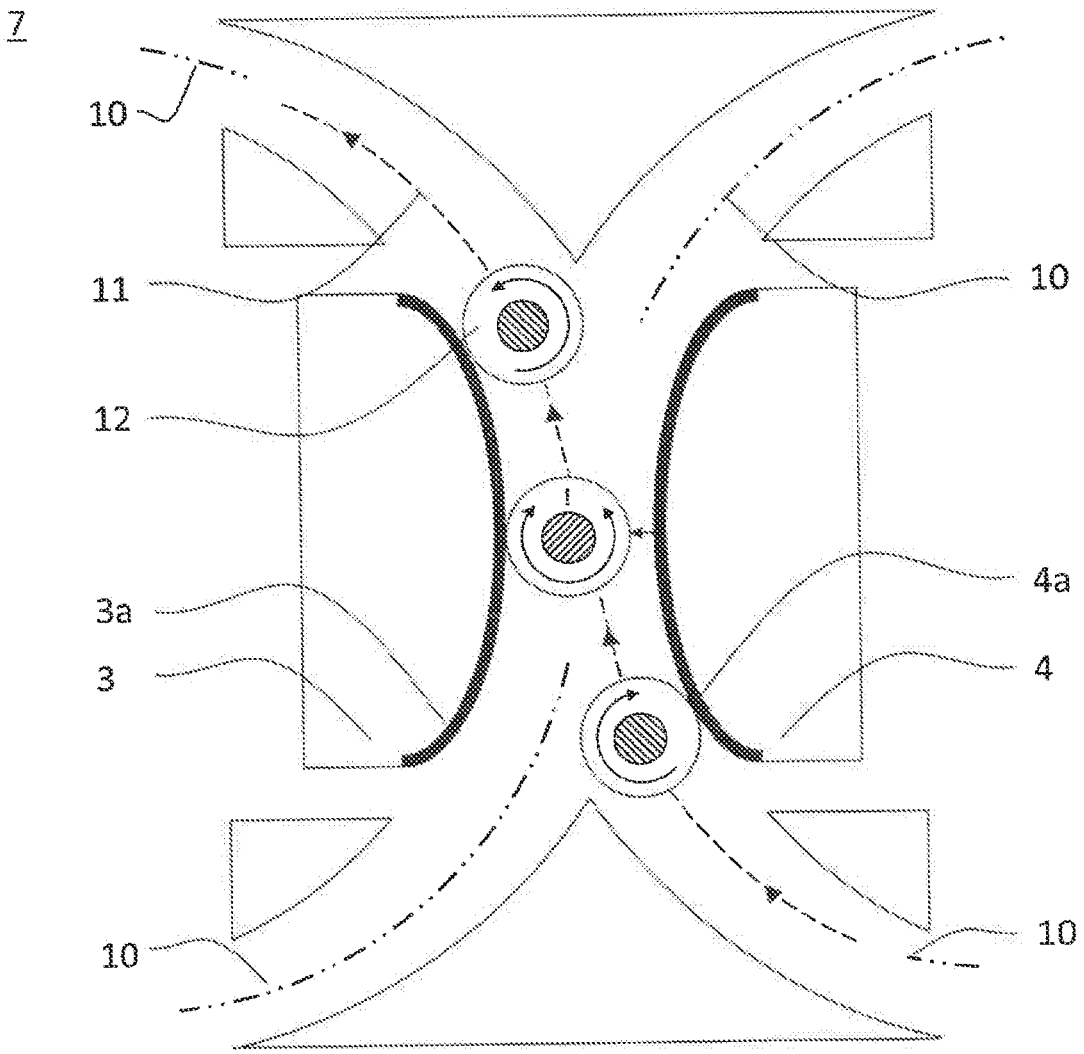
FIG. 5 shows the track of a guide element of a bobbin through the switch in a braiding machine, with the guide element moving from one impeller to another impeller and here retaining its direction of motion.

In FIGS. 4 and 5 the switch 7 arranged between the impellers 10 is shown in an enlarged fashion. This switch 7 comprises a track 11 branched into two tracks and/or deflection tracks 11*a* and 11*b*, which show the form of an arc matching the arc shape of the impellers 10. This means that a track 11 of one of the two impellers 10 meets another track 11 of a neighboring impeller 10 such that two tracks 11 are arranged and/or provided according to the impellers 10 inside the switch 7. The guide element 12 can pass through the track 11 of the switch 7 and, depending on the electrification of one of the two electromagnets 3, 4, can be deflected in order to enter into the respectively other track 11 of the neighboring impeller 10. In other words, the guide element 12 can be selectively deflected via the targeted electrification of the switch 7 into a respective output path 11*a* and/or 11*b* and thus be transferred to the respective impeller 10.

Here FIG. 4 shows the activation of the left magnet 3 such that the guide element 12 maintains its track 11 at the left impeller 10 (not shown). Here, the cylindrical guide element 12 rolls on and/or at a guide surface 3*a* of the left magnet 3 in order to (particularly with little friction) run and/or glide and/or roll over the electromagnet 3.

For this purpose, preferably the guide element 12 is embodied in a cylindrical fashion and further preferred supported rotationally at the bobbin 8. According to a simpler embodiment however, the rotational support of the guide element 12 can be waived.

FIG. 5 shows a transfer and/or a transfer process of the bobbin 8 with the guide element 12 from the track 11 of the right impeller 10 (not shown) to the track 11 of the left impeller 10 (not shown). After the guide element 12 has entered the switch 7 the guide element 12 rolls initially on the guide surface 4*a* of the right electromagnet 4. However, since the right electromagnet 4 is deactivated and only the left electromagnet 3 is electrified, in order to generate an electromagnetic field, the guide element 12 of the bobbin 8 is attracted by the left electromagnet 3 and thus changes to the left side in order to roll on the guide surface 3 of the left electromagnet 3. This way the guide element 12 is transferred to the track 11 of the left impeller 10.

Figure 6:
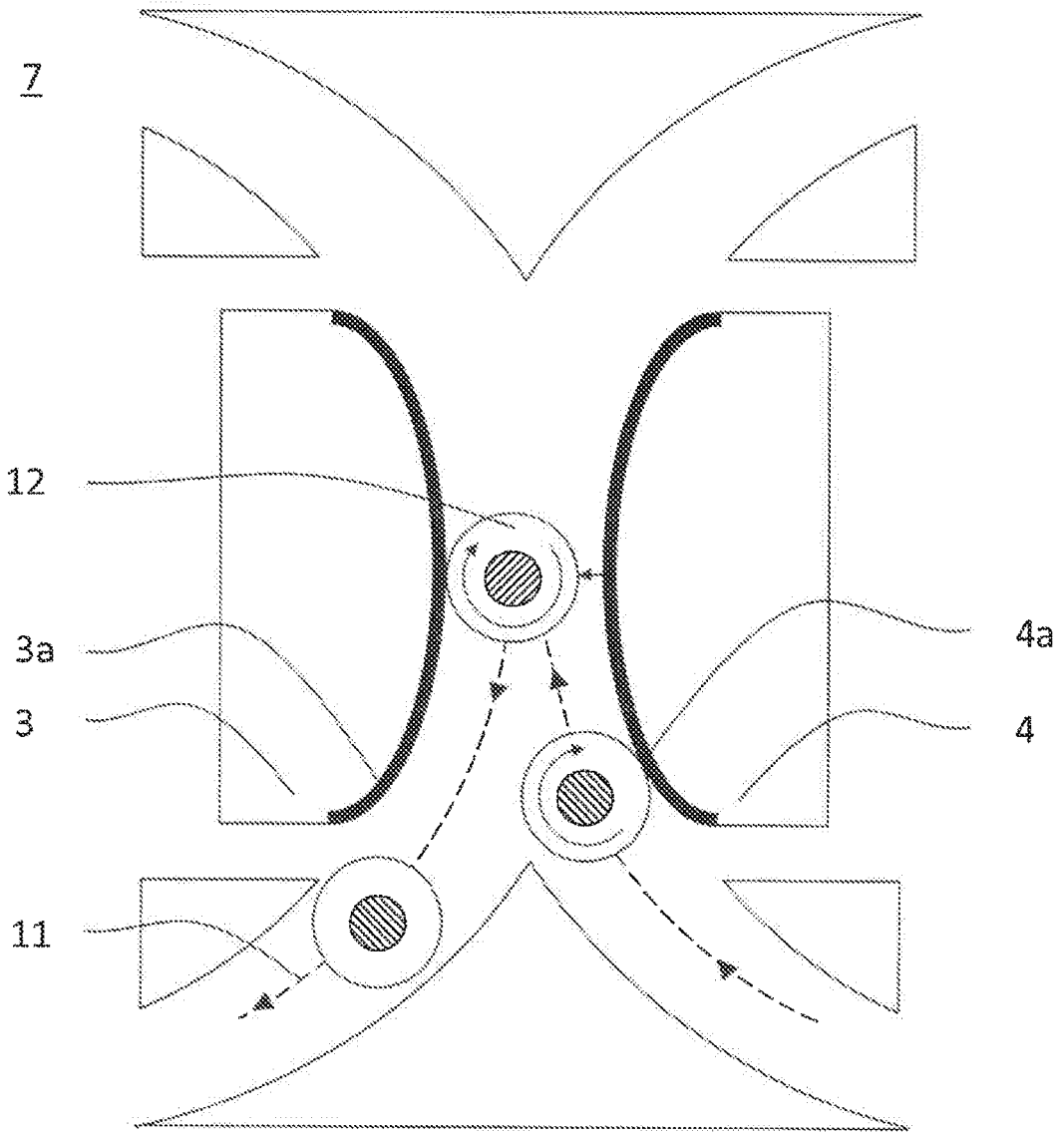
FIG. 6 shows the track of a guide element of a bobbin through the switch in a braiding machine, with the guide element moving from one impeller to another impeller and here changing its direction of motion.

FIG. 6 shows now an inversion of the direction of a bobbin 8 with the guide element 12. Here, the adjacent impellers 10 rotate in the proximity of the switch 7 in opposite directions. This means that the impellers 10 actually rotate in the same direction, i.e. in the clockwise direction as shown in FIG. 6, for example. This means that the left part of the arc of the right impeller 10 located inside the switch 7 moves upwards while the right arc of the left impeller 10 moves downwards. This way, the motion inside the track 11 of the left impeller 10 is opposite the one inside the track 11 of the right impeller 10.

When now a bobbin 8 enters with its guide element 12 into the switch 7, the guide element 12 is attracted here by the activated left electromagnet 3 and is transferred from the right impeller 10 to the left impeller 10.

The transfer represents here that the guide groove 15 leaves the conveying groove 9 of the right impeller 10 and enters into a matching conveying groove 9 of the left impeller 10. Accordingly, the bobbin 8 is now released by the right impeller 10 and moved by the left impeller 10 such, as shown in FIG. 6, that the guide element 12 (e.g., in the middle of the switch 7) essentially reverses its direction and follows downwards the track 11 of the left impeller 10.

It is understood that when using a plurality of impellers 10, respectively connected by a plurality of switches 7, a very flexible type of movement of a bobbin 8 can be yielded via the guide elements 12 in connection with the guide groove 15, being moved by a conveying groove 9 of the impeller 10. In particular, a movement pattern of the bobbin 8 can easily be changed such that either the left electromagnet 3 or the right electromagnet 4 of a plurality of switches 7 is electrified in order to deflect the ferromagnetic guide element 12 and thus the respectively thereby guided bobbin 8 is deflected to the left or the right.

Here each of the impellers 10 may show at least one conveying groove 9 or a plurality of conveying grooves 9. The electrification of the electromagnet 3, 4 only needs to be adjusted to the speed of the impellers 10 and/or be clocked accordingly. Any manual intervention for altering a switch 7 and/or mechanically switching the switch 7 is waived in this design. Here, any deflection and/or change of track of a bobbin 8 can be implemented in a very rapid fashion and very flexibly.

Figure 7:
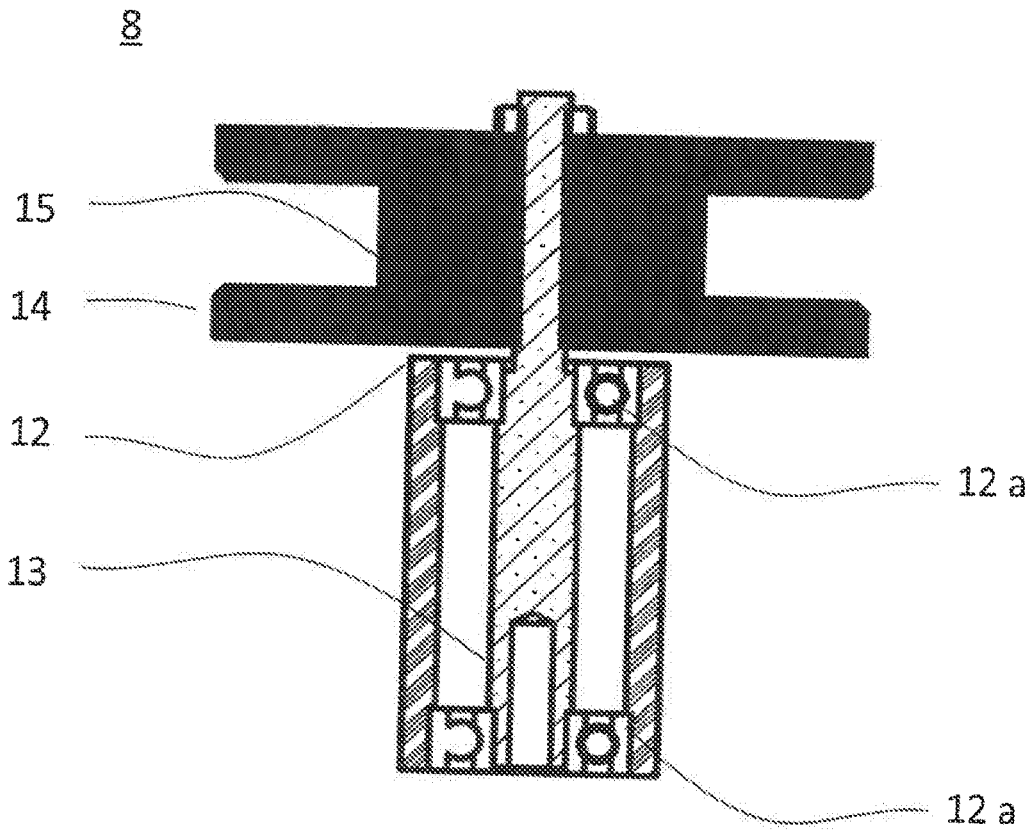
FIG. 7 shows the design of a bobbin in a round and rolling guide element.

In FIG. 7 a preferred embodiment of a bobbin 8 is shown. This bobbin 8 shows, concentric in reference to the bobbin base 14, a connection shaft 13 to the guide groove 15, at which the guide element 12 is supported in a rotational fashion via a pair of ball bearings 12*a*. Such a rotationally supported guide element 12 can roll in a very gentle fashion and with little friction on the appropriate guide surfaces 3*a*, 4*a* of the electromagnets 3, 4.

The invention is however not limited to such a rotational arrangement of the guide element 12. For example, the ball bearings 12*a* can be waived when the guide element 12 is made of and/or comprises a particularly low-friction material, for example Teflon, or a chrome-coated metallic surface.

Figure 8:
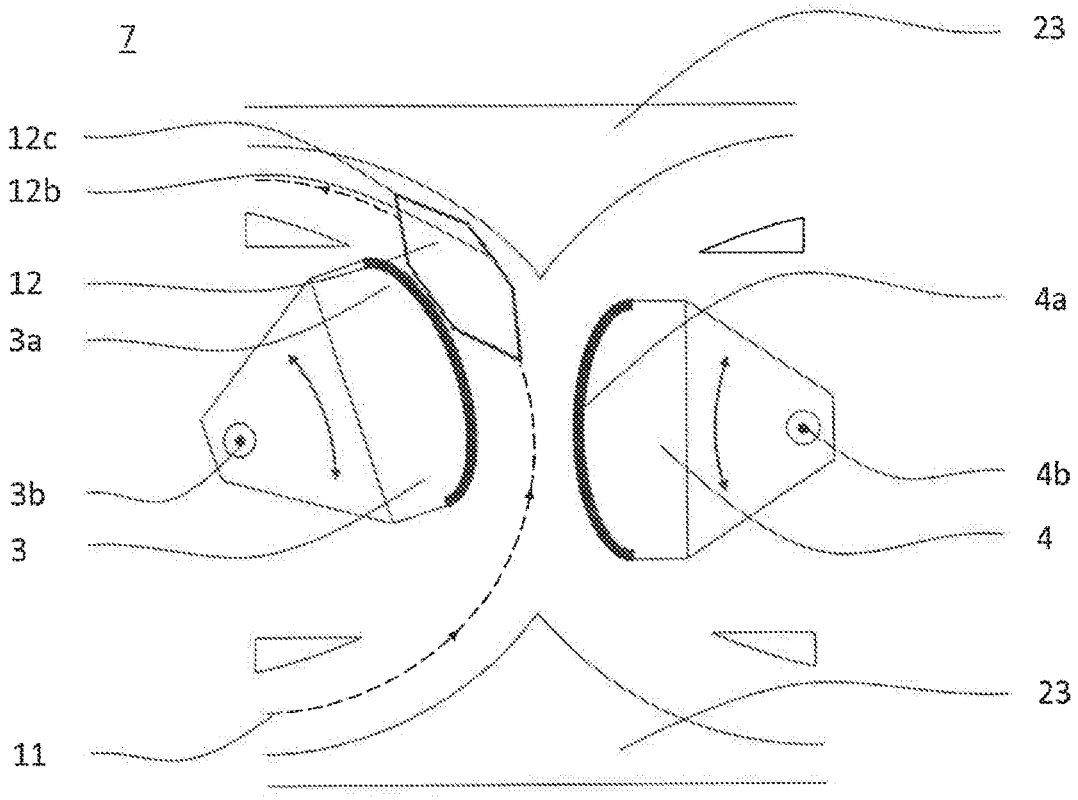
FIG. 8 shows the design of a switch with a mobile electromagnet to convey and deflect non-round components and/or tapered guide elements.

FIG. 8 shows a variant of the guide element 12 in which the guide element 12 is not cylindrical, but rectangular and/or polygonal with tapered and/or conical ends 12*c*.

Based on the tapered ends 12*c* the guide element 12 easily finds its way into the track 11 of the switch 7. Side faces 12*b* glide along the respective guide surfaces 3*a*, 4*a* of the electromagnets 3, 4. Here, the entire guide element 12 is made particularly from an appropriately low-friction synthetic or metal. It is also possible that the ends 12*c* are at least partially rounded.

As also shown in FIG. 8, the electromagnets 3, 4 may be supported pivotally at an appropriate point of rotation 3*b*, 4*b* in order to be moved by a certain distance together with the guide element 12. Preferably the electromagnet 3, 4 is positioned by a spring (not shown) in its central and/or default position and or biased thereto. By appropriate impingement with force and/or friction the electromagnet 3, 4 is displaced out of its central position, particularly deflected about the point of rotation 3*b*, 4*b*. After the contact between the guide element 12 and the guide surface 3*a*, 4*a* has been released the electromagnet 3, 4 returns to its central position and/or default or starting position, due to the spring force of the spring (not shown).

This embodiment of the displaceable and/or pivotal electromagnets 3, 4 is preferably applicable for a guide element 12 which is supported in a non-rotary fashion. The application is however not limited thereto, but can also be used for a guide element 12 supported in a rotary fashion.

In the FIGS. 9 to 15 different types of round braiding machines are shown with appropriate switches 7 according to the invention.

Figure 9:
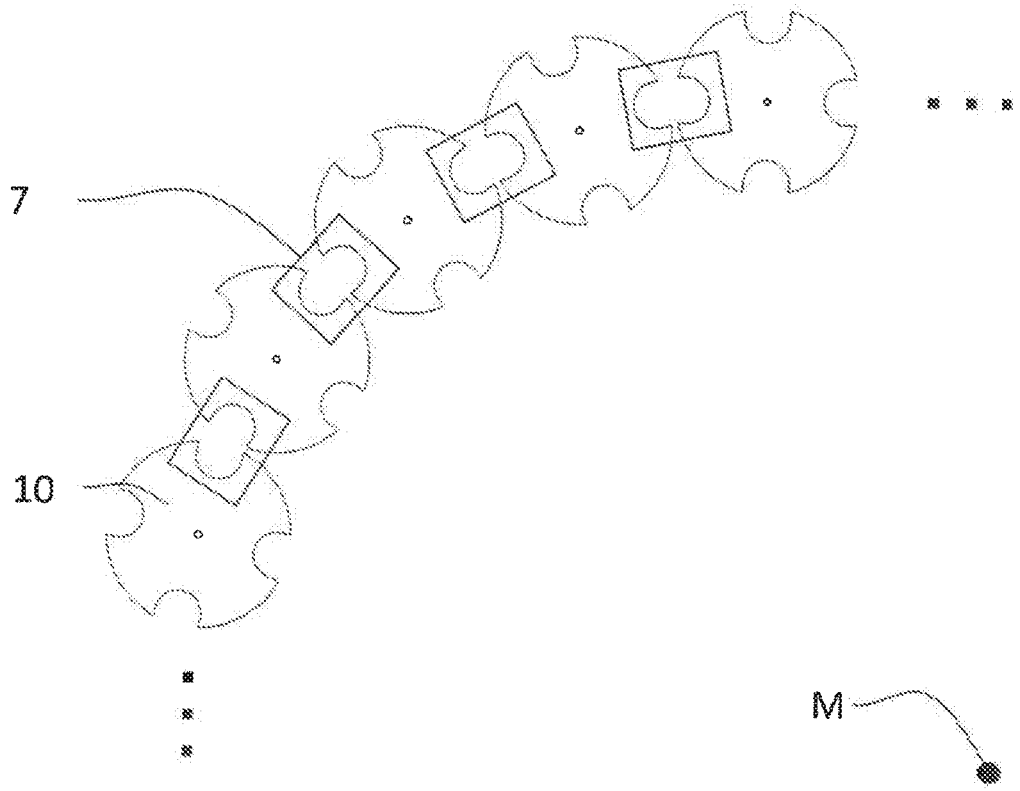
FIG. 9 shows a schematic design of a classic round braiding machine with the switch according to the invention.

In FIG. 9 a braiding machine is shown in which a plurality of impellers 10 is arranged on a circle (shown only partially) with a center M. One switch 7 is respectively arranged between two adjacent impellers 10 according to a particular embodiment. Each of the impellers 10 comprises here a conveying groove 9, offset by respectively approximately 90° along its perimeter, thus a total of four conveying grooves 9, in order to move the bobbins 8 along the perimeter of the impeller 10. According to the invention however a different number of conveying grooves 9 (e.g., one, two, three, or five, or more conveying groove(s)) are possible per impeller 10. This way, the bobbins 8 can be moved along the perimeter of an individual impeller 10 or alternatively be transferred to the adjacent impeller 10. It is understood that this way a very flexible braiding process can be implemented without requiring that the machine is retrofitted or modified. Furthermore, the transfer of a bobbin 8 by the switch 7 can occur in a very rapid fashion by merely activating and/or electrifying one of the two electromagnets 3, 4.

Figure 10:
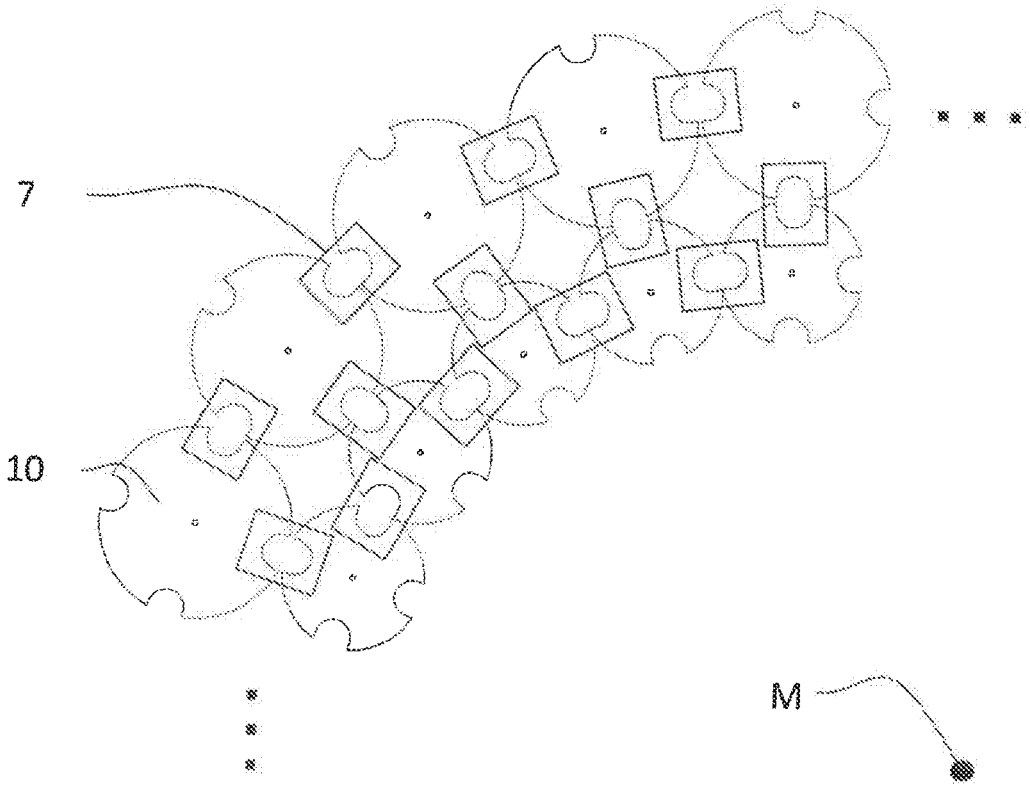
FIG. 10 shows a schematic design of an expanded round braiding machine with several rings and a switch according to the invention.

In FIG. 10 another embodiment is shown of a particular version of a braiding machine in which a second concentric circle of impellers 10 is arranged about the center M. This way the bobbins 8 can be moved along one of the two concentric circles respectively formed by a plurality of impellers 10. Furthermore, at least one switch 7 is arranged between adjacent impellers 10 of one of the circles and an impeller 10 of another circle. In the illustration of FIG. 10 respectively one switch is arranged between adjacent impellers 10 of one circle or the other circle. This way a bobbin 8 can be transferred from one of the concentric circles to the other concentric circle. This way the braiding process becomes even more flexible.

It is understood that the invention is not limited to the arrangement of two concentric circles at impellers 10 but can be arranged also on a plurality, i.e. three, four, five, or even more concentric circles of impellers 10. Furthermore the invention is not limited to impellers 10 with four conveying grooves 9, but any arbitrary number of conveying grooves 9 may be arranged at the impeller 10 or at several impellers 10.

Figure 11:
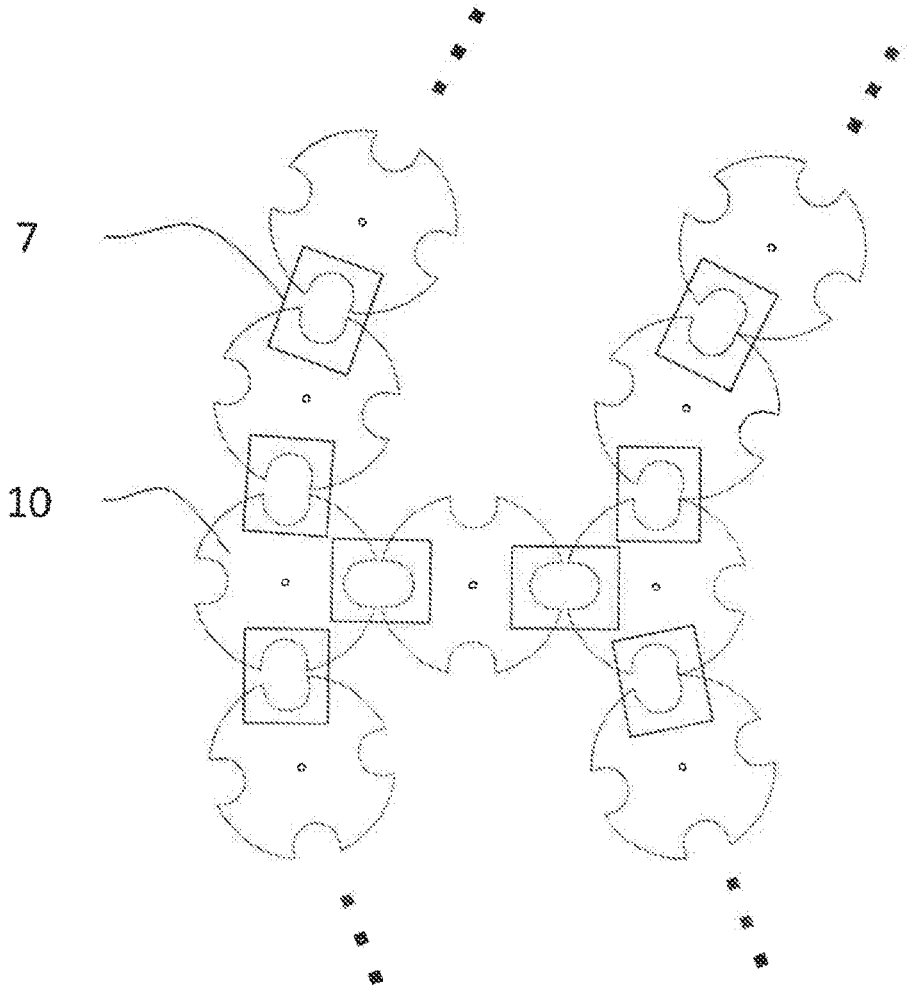
FIG. 11 shows a schematic design of an expanded round braiding machine with several rings, which are connected by an additional impeller and the switch according to the invention.
Figure 12:
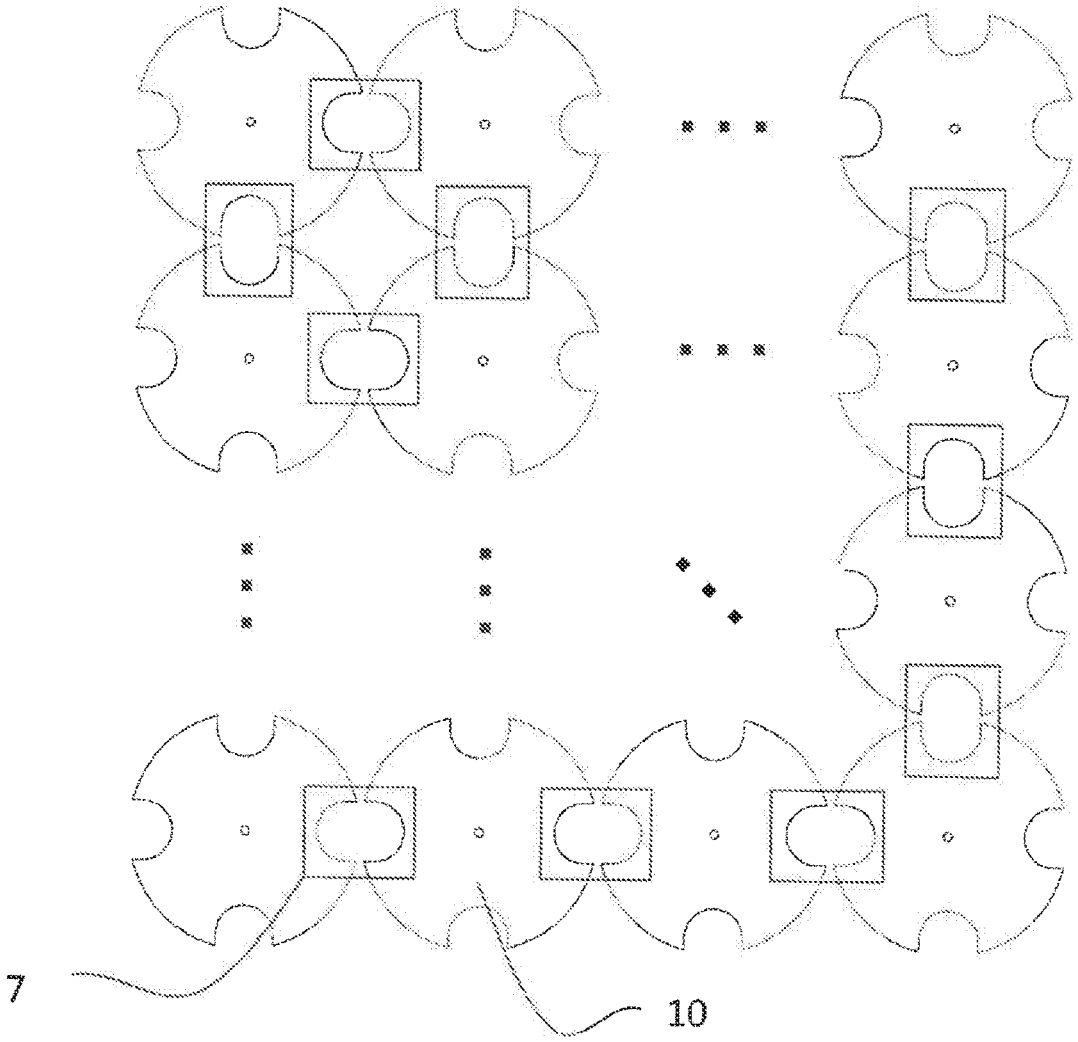
FIG. 12 shows a schematic design of a square or rectangular braiding machine with an arbitrary number of impellers, which are arranged in rows and columns, and switches according to the invention.
Figure 13:
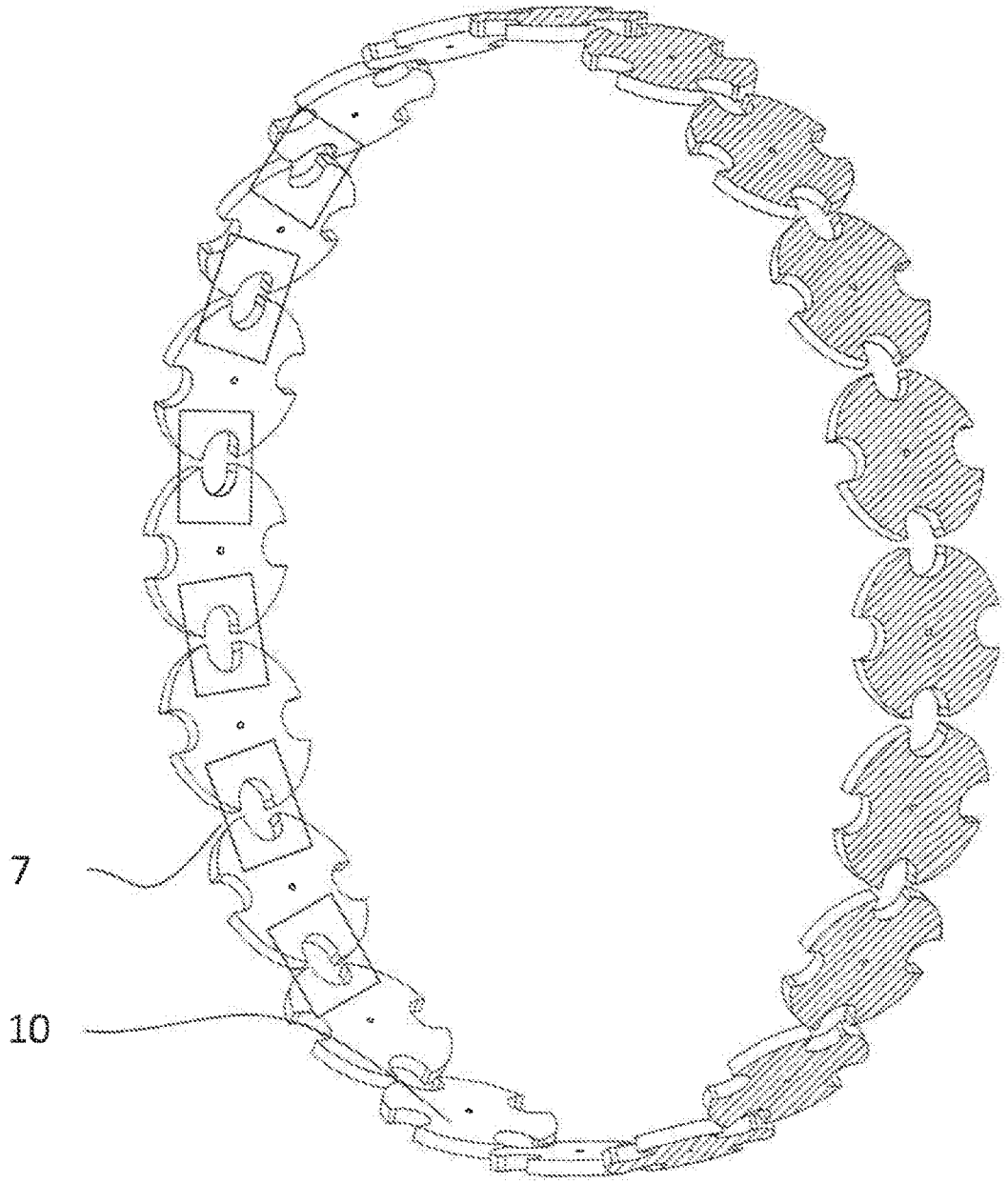
FIG. 13 shows a schematic design of a round braiding machine and the switches according to the invention.

Another potential embodiment is the arrangement of an individual impeller 10 between two concentric circles of a plurality of impellers 10, as shown in FIG. 11. This way a bobbin 8 can be transferred from one of the concentric circles to the other concentric circle via the single impeller 10 arranged between the two concentric circles. It is understood that by such an arrangement of an individual impeller 10 between concentric circles of impellers 10 further improved flexibility of a braiding process is possible.

Figure 14:
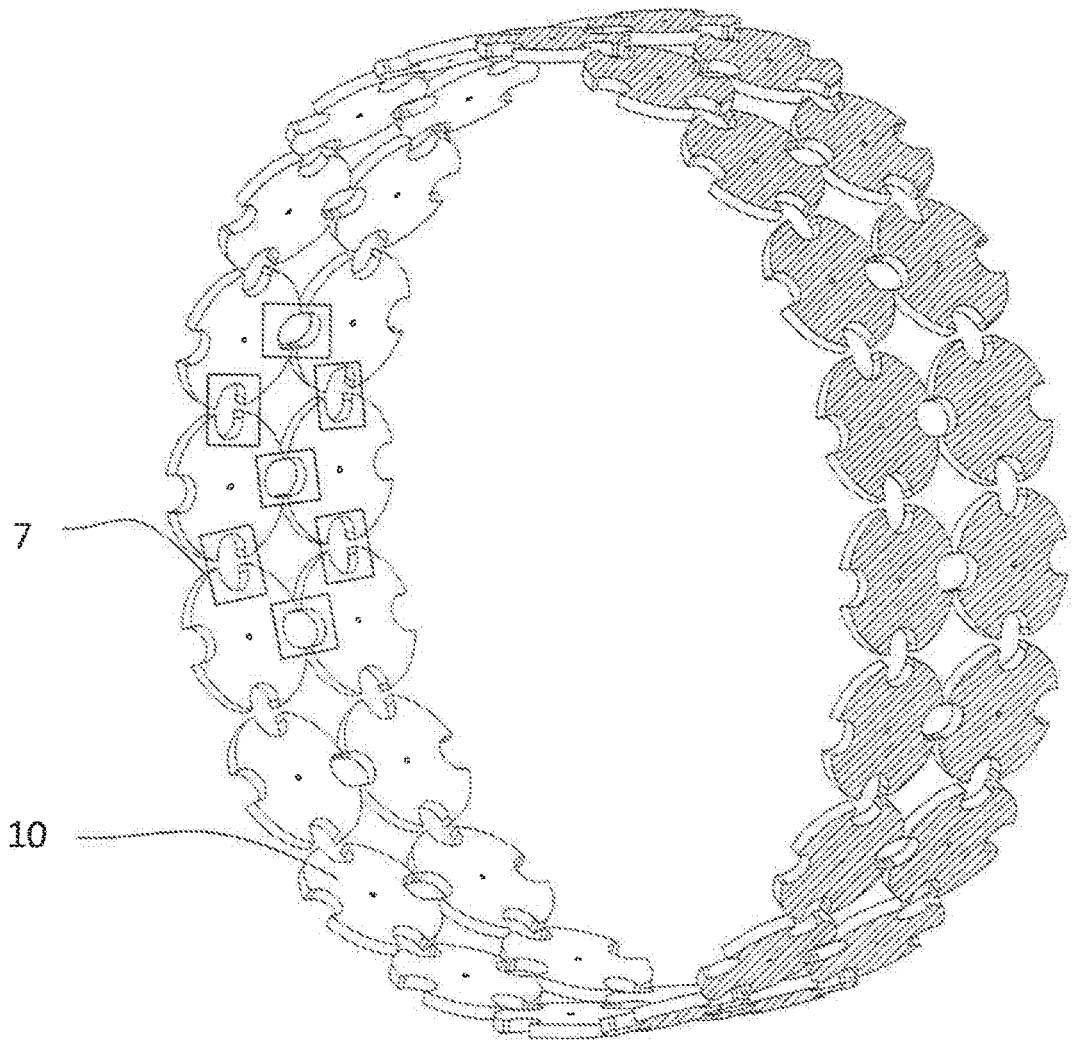
FIG. 14 shows a schematic design of an expanded round braiding machine with two rings and the switch according to the invention.

The invention is however not limited to the arrangement of concentric circles of impellers 10. Rather, the impellers 10 can also be arranged according to a rectangle or a predetermined and/or predeterminable pattern and/or matrix in rows and columns, as shown for example in FIG. 12. Furthermore, the plurality of impellers 10 can be arranged with the switches 7 arranged there between along the perimeter of a cylinder, as shown for example in FIG. 13. Here it is of course also possible that a plurality of cylindrical circles of impellers 10, shown in FIG. 13, can be arranged side-by-side. For simplification, FIG. 13 only shows one cylindrical circle of impellers 10, though. FIG. 14 shows an example of two cylindrical circles of impellers 10. Here, the cylindrical circles arranged side-by-side can in turn be connected respectively by one or more switches 7.

Figure 15:
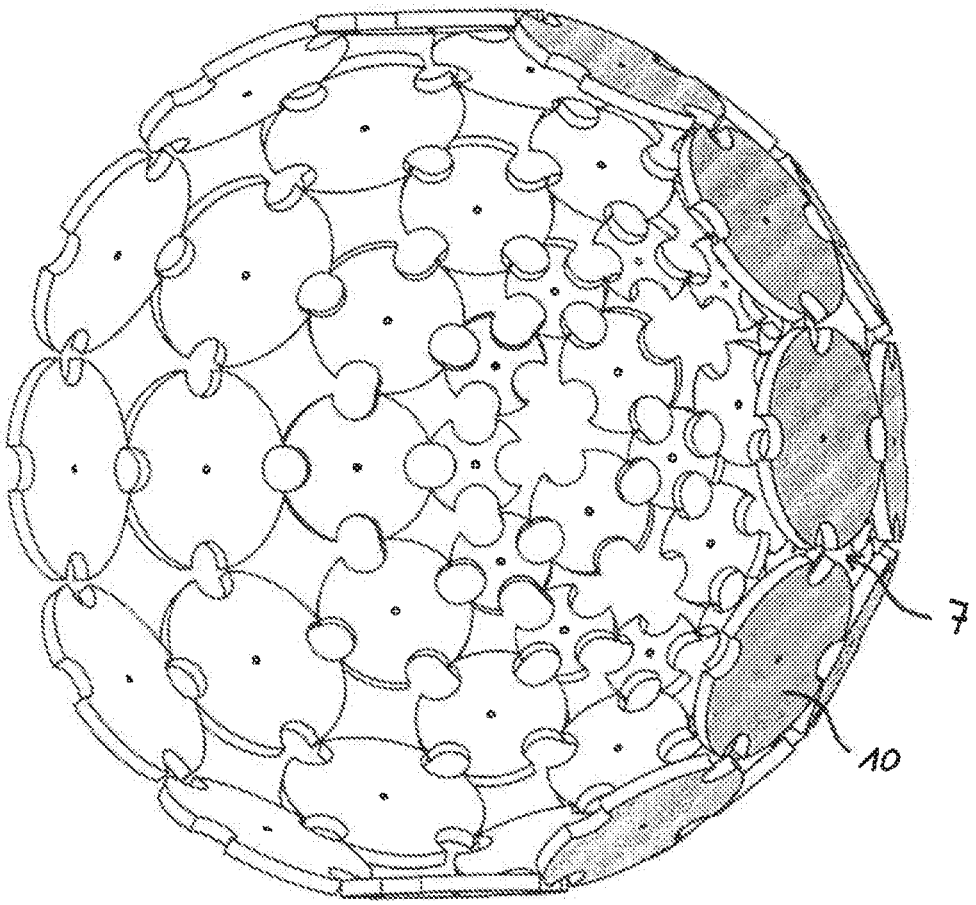
FIG. 15 shows a schematic design of a spherical "hollow sphere" braiding machine and the switches according to the invention.

Furthermore it is possible to arrange the impellers along the surface of a hemisphere, as shown in FIG. 15.

The invention is not limited to the arrangement of impellers 10 according to FIGS. 9 to 15 but here further arbitrary arrangements of a plurality of impellers 10 can be implemented within the scope of the invention.

The invention is also not limited to an electromagnetic switch 7 for a braiding machine, but other ferromagnetic objects 1 than the bobbins 8 can be influenced with the guide elements 12 by such an electromagnetic switch 7 in their track of motion.

Here, for example, it is possible to provide a sorting apparatus for ferromagnetic objects 1, which alternatively are guided into one or another path. For this purpose, a respective sorting apparatus as shown in FIG. 1 comprises for example an inlet 20, which preferably is embodied approximately like a funnel, and into which from the top a plurality of ferromagnetic objects 1 is supplied. Further downstream inside a track of motion of the ferromagnetic objects 1 a pair of electromagnets 3, 4 is located, which depending on electrification laterally deflect the ferromagnetic objects 1 to the left (deflection path 11*a*) towards the left electromagnet 3 or to the right (deflection path 11*b*) towards the right electromagnet 4. This way the ferromagnetic objects 1 are discharged to the left or the right in an outlet 21 of the sorting apparatus. Below the outlet 21 a separating device 23 may be located, which comprises and/or branches into an outlet path to the left or the right.

Preferably the sorting apparatus can further provide a slider 22, particularly upstream in reference to the electromagnets 3, 4, in order to control and/or regulate the supply of electromagnetic objects 1 based on the gravity thereof. In other words, the slider 22 can selectively block or release the passage of one or more ferromagnetic objects 1 by inserting the slider 22 at least partially into the path of the ferromagnetic objects 1 or pulling it out of this path.

This way the sorting apparatus can separate the ferromagnetic objects 1, for example according to good or bad parts. The invention is however not limited thereto, but ferromagnetic objects 1 can also be allocated to at least two or more paths based on completely different criteria. For this purpose, for example several appropriate sorting apparatuses with a pair of electromagnets 3, 4 can be arranged behind one another in order to generate several branching and/or sorting units.

By the sorting apparatus, using an electromagnetic force to guide an object to a respective path, for example "good" and "bad parts" can be separated.

Therefore a switch 7 is provided for the selective sorting, deflecting, supplying of ferromagnetic elements 1. Here, the switch 7 comprises at least two electromagnets 3, 4, which are essentially embodied in a curved or circular fashion. The magnets 3, 4 can be installed fixed and/or locally immobile in the switch 7, on the one hand, or positioned on an axis 3*a* in a mobile and/or displaceable fashion, on the other hand. The ferromagnetic elements 1 are moved by a guide and/or conveying element 12 through the switches 7. Advantageously the switch 7 can also be used for guiding bobbins 8 of a braiding machine. Here the bobbin 8 can be flexibly transferred to another impeller 10. This way new options are generated with regard to flexibility of braids. Further, this invention offers a considerable reduction of braiding time in case of complex braids.

LIST OF REFERENCE CHARACTERS

1 ferromagnetic object
2 deflected (sorted) object
3 electromagnet
3*a* guide surface
3*b* point of rotation
4 electromagnet
4*a* guide surface
4*b* point of rotation
5 magnet casing
6 magnet core
7 switch
8 bobbin
9 conveying groove
10 impeller
11 track
11*a*, 11*b* (output) path
12 guide element
12*a* ball bearing
12*b* side face
12*c* tapered end
13 connection shaft
14 bobbin base
15 guide groove
20 inlet
21 outlet
22 slider
23 separating apparatus
M center

What is claimed is:

1. A braiding machine comprising:

at least one bobbin, at least two impellers for displacing the at least one bobbin, and at least one switch for changing and/or inverting a track of motion of the at least one bobbin, with the at least one bobbin being made at least partially from a ferromagnetic material and comprising a guide groove for relatively positioning the bobbin and the impeller, the at least one switch including at least one electromagnet and wherein the at least one switch comprises a branched track having a form of an arc corresponding to an arc shape of the at least two impellers, and the at least one bobbin further comprises a guide element for guiding the bobbin selectively into one of two deflection tracks.

2. The braiding machine according to claim 1, wherein the at least one electromagnet comprises a guide surface and wherein the guide element of the at least one bobbin is cylindrical or tapered and contacts the guide surface of the at least one electromagnet.

3. The braiding machine according to claim 2, wherein the cylindrical or tapered guide element is supported rotationally at the at least one bobbin.

4. The braiding machine according claim 2, wherein the at least one electromagnet and/or the guide surface thereof are embodied in a curved or arc-shaped fashion.

5. The braiding machine according to claim 1, wherein the at least one electromagnet is supported pivotally in order to be reset.

6. The braiding machine according to claim 1, wherein a plurality of impellers are arranged on a planar area over each other and side-by-side in rows and columns or in a circular fashion.

7. The braiding machine according to claim 1, wherein a plurality of impellers are arranged in concentric circles and each of the concentric circles includes the same number of impellers.

8. The braiding machine according to claim 7, wherein at least one additional impeller is arranged in a clearance between at least two of the concentric circles.

9. The braiding machine according to claim 1, wherein a plurality of impellers are arranged on a perimeter of a cylinder such that all bobbins are aligned in the direction towards an axis of the cylinder, or a plurality of impellers are arranged on a surface of a hemisphere such that all bobbins are equidistant from a braiding point located in a center of the hemisphere.

* * * * *